US008800791B2

(12) United States Patent
Franzen et al.

(10) Patent No.: US 8,800,791 B2
(45) Date of Patent: Aug. 12, 2014

(54) BRIDGE CRANE OR GANTRY CRANE COMPRISING A REVOLVING ARRANGEMENT AND LIFTING FRAMES SUSPENDED THEREUNDER

(75) Inventors: Hermann Franzen, Mönchengladbach (DE); Armin Wieschemann, Oberhausen (DE); Mike Hegewald, Oberhausen (DE); Jannis Moutsokapas, Monheim (DE)

(73) Assignee: Gottwald Port Technology GmbH, Düsseldorf (DE)

( * ) Notice: Subject to any disclaimer, the term of this patent is extended or adjusted under 35 U.S.C. 154(b) by 256 days.

(21) Appl. No.: 13/133,532

(22) PCT Filed: Nov. 30, 2009

(86) PCT No.: PCT/EP2009/066088

§ 371 (c)(1),
(2), (4) Date: Jun. 8, 2011

(87) PCT Pub. No.: WO2010/066604

PCT Pub. Date: Jun. 17, 2010

(65) Prior Publication Data

US 2011/0240584 A1 Oct. 6, 2011

(30) Foreign Application Priority Data

Dec. 9, 2008 (DE) ..... 10 2008 061 199

(51) Int. Cl.
*B66C 17/00* (2006.01)
*B66C 19/00* (2006.01)
*B66C 21/00* (2006.01)

(52) U.S. Cl.
USPC ..... 212/319; 212/77; 212/330

(58) Field of Classification Search
USPC ..... 212/312, 314, 315, 317, 318, 319, 328, 212/329, 330, 71, 76, 77
See application file for complete search history.

(56) References Cited

U.S. PATENT DOCUMENTS 1,035,265 A * 8/1912 Taylor ..... 212/331
2,659,827 A * 11/1953 Scag et al. ..... 250/493.1

(Continued)

FOREIGN PATENT DOCUMENTS

DE 2214348 A1 10/1973
DE 2752212 A1 5/1979

(Continued)

OTHER PUBLICATIONS

Translation of JP 49014575 B, Jan. 2014, The McElroy Translation Company.*

(Continued)

*Primary Examiner* — Emmanuel M Marcelo
*Assistant Examiner* — Justin Stefanon
(74) *Attorney, Agent, or Firm* — Gardner, Linn, Burkhart & Flory, LLP

(57) ABSTRACT

A bridge crane or gantry crane is provided for transferring standard cargo holders, especially ISO containers in port zones. A crane trolley is movable along a crane carrier. A rigid mast is guided on the crane trolley and extends in a raising and lowering direction and can be moved using at least one lifting gear and cables on the crane trolley. A load accepting device for standard cargo holders is fastened to the lower end of the mast. The mast is rotatable about a longitudinal rotational axis. A lifting frame supports the lifting gear and is suspended on the crane trolley by a revolving arrangement that includes a revolving tube. An upper end of the revolving tube rests against the crane trolley using a revolving joint, while the lifting frame is mounted on a lower end of the revolving tube. The mast is arranged coaxially to the revolving tube.

14 Claims, 7 Drawing Sheets

(56) References Cited

U.S. PATENT DOCUMENTS

| | | | | | |
|---|---|---|---|---|---|
| 2,869,734 | A | * | 1/1959 | Ernestus | 212/317 |
| 3,247,974 | A | * | 4/1966 | Dechantsreiter | 414/591 |
| 3,550,788 | A | * | 12/1970 | Yendrich, Jr. et al. | 212/274 |
| 3,812,987 | A | | 5/1974 | Watatani | |
| 3,874,514 | A | * | 4/1975 | Wilson | 212/290 |
| 3,899,083 | A | | 8/1975 | Flessner et al. | |
| 4,496,063 | A | * | 1/1985 | Ishii et al. | 212/270 |
| 5,489,033 | A | * | 2/1996 | Luebke | 212/318 |
| 5,492,236 | A | * | 2/1996 | Foy | 212/333 |
| 6,715,977 | B2 | | 4/2004 | Dobner et al. | |
| 7,004,338 | B2 | | 2/2006 | Franzen et al. | |
| 7,410,339 | B2 | * | 8/2008 | Franzen et al. | 414/140.3 |
| 2011/0240583 | A1 | * | 10/2011 | Franzen et al. | 212/318 |

FOREIGN PATENT DOCUMENTS

| | | | | |
|---|---|---|---|---|
| DE | 2911938 | A1 | | 10/1980 |
| DE | 20013245 | | | 12/2001 |
| EP | 1365984 | B1 | | 12/2003 |
| GB | 696581 | A1 | | 9/1953 |
| JP | 49-14575 | | | 4/1974 |
| JP | 49014575 | | * | 9/1974 ..... B66C 11/10 |
| JP | 61-248827 | | | 6/1986 |
| JP | 2008-156013 | | | 10/2008 |

OTHER PUBLICATIONS

International Preliminary Examination Report (IPER) for International Application No. PCT/EP2009/066088, which corresponds to the current application.

Substitute Specification, drawings, and Preliminary Amendment from co-pending U.S. Appl. No. 13/132,118, filed Jun. 1, 2011.

Substitute Specification, drawings, and Preliminary Amendment from co-pending U.S. Appl. No. 13/133,459, filed Jun. 8, 2011.

Substitute Specification, drawings, and Preliminary Amendment from co-pending U.S. Appl. No. 13/133,616, filed Jun. 8, 2011.

International Search Report and Written Opinion of the International Searching Authority from corresponding Patent Cooperation Treaty (PCT) Application No. PCT/EP2009/066088, mailed Mar. 15, 2010.

English translation of the International Search Report of the International Searching Authority from corresponding PCT Application No. PCT/EP2009/066088, mailed Mar. 15, 2010.

Japanese Examination Report (English translation) of corresponding Patent Application No. JP 2011-528371, dated Feb. 5, 2013.

* cited by examiner

BRIDGE CRANE OR GANTRY CRANE COMPRISING A REVOLVING ARRANGEMENT AND LIFTING FRAMES SUSPENDED THEREUNDER

FIELD OF THE INVENTION

The invention relates to a bridge crane or gantry crane for handling standard load carriers, in particular for handling ISO containers in a port area.

BACKGROUND OF THE INVENTION

European patent EP 1 365 984 B1 discloses a bridge crane for stacking containers, in particular ISO containers, which, within a container terminal, places containers into storage in a warehouse area or removes them from storage therein. The bridge crane has a crane carrier which spans a substantially cuboidal warehouse area widthwise. A crane trolley can travel on the crane carrier and in the longitudinal direction thereof in the width direction of the warehouse area. The crane carrier can travel via running gears on rails in the crane travel direction and therefore transverse to the crane trolley on the crane carrier and in the longitudinal direction of the warehouse area. In order to be able to handle the containers, a mast is disposed on the crane trolley, is guided in the vertical direction, and can be raised and lowered. The mast is formed as a box carrier, and lifting mechanisms are disposed on the crane trolley for the lifting and lowering movement of the mast. On the lower end of the mast, which is oriented in the direction of the containers to be handled, a load-receiving means for containers, in particular a so-called spreader, is suspended in an articulated manner. The load-receiving means is connected to the lifting mechanisms on the crane trolley via cables. The mast is not directly driven in the lifting and lowering direction, but only indirectly via the cables engaging on the load-receiving means. The use of a rigid mast between the crane trolley and the load-receiving means offers the advantage that it is possible to handle the containers without them swinging to a great degree in contrast to load-receiving means, which are also used and are suspended exclusively on cables.

German laid-open document DE 29 11 938 B2 discloses a crane installation for handling containers in the case of railway transportation. This crane installation is formed as a gantry crane which in a conventional manner has a horizontally extending bridge carrier on which a trolley can travel. This trolley supports a column-like mast which is able to move vertically in the lifting and lowering direction. A load-receiving means for the containers is attached to the lower end of the mast. In order to be able to rotate the load-receiving means and the mast about a vertical axis the mast is guided in the region of its upper end eccentrically on a circular ring-shaped intermediate frame in which a lifting mechanism, which is connected to the mast via cables, is centrally disposed. The annular intermediate frame is able to travel in the revolving direction via running gears on an annular rail disposed on the trolley, and can therefore rotate the mast including the load-receiving means for the containers, which is disposed thereon, about a vertical axis.

Furthermore, German utility model DE 200 13 245 U1 discloses a device for handling containers in the case of railway transportation, which is formed in the manner of a pillar jib crane. This device accordingly has a vertical upright pillar, on the upper end of which a horizontally extending, projecting jib is disposed so as to be able to pivot about a vertical axis. At the end of the jib, remote from the upright pillar, a crane jib for a trolley that can travel along it, is suspended via a revolving mechanism with a vertical axis.

This trolley has a lifting mechanism and two vertically downwardly extending lifting masts, along which a lifting carriage is able to move in the lifting and lowering direction with the aid of the lifting mechanism. At the lower end of the carriage is a load-receiving means for the containers.

Furthermore, German laid-open document DE 27 52 212 A1 discloses a transfer device for containers in the case of railway transportation, which is formed essentially as a gantry crane with a trolley. A load-receiving means for the containers is suspended on the trolley via a vertical pillar. The pillar, which cannot be raised and lowered, is supported on the trolley via a revolving device at its upper end, and can therefore be rotated about its vertical axis of rotation. Furthermore, the load-receiving means is suspended by lifting mechanisms so as to be moveable to a slight degree in the lifting and lowering direction at the lower end of the mast.

SUMMARY OF THE INVENTION

The present invention provides an optimized bridge crane or gantry crane with a rigid jib for handling standard load carriers, in particular ISO containers, in the area of port cargo handling.

In accordance with one aspect of the invention, a bridge crane or gantry crane for handling standard load carriers, in particular for handling ISO containers in a port area, has a crane trolley which can move along a crane carrier in the trolley travel direction, on which crane trolley a rigid mast, which extends in a lifting and lowering direction, is guided. The mast can move via at least one lifting mechanism disposed on the crane trolley via cables in the lifting and lowering direction. A load-receiving means for standard load carriers is attached at the lower end of the mast, wherein the mast is suspended on the crane trolley so as to be able to rotate about an axis of rotation extending in its longitudinal direction. An optimisation of the usage possibilities may be achieved in that the lifting frame is suspended by a revolving arrangement on the crane trolley, which lifting frame supports the at least one lifting mechanism. The revolving arrangement includes a revolving pipe with an upper end and a lower end. The revolving pipe is supported on the crane trolley with its upper end via a revolving connection. The lifting frame is attached to the lower end of the revolving pipe, and the mast is guided in such a way that it can be raised and lowered in the revolving pipe and coaxially relative to the revolving pipe. In this way, it is possible to orient standard load carriers in any angular positions as may typically be required within a handling installation in order to facilitate onward transportation. The creation of a lifting frame in addition to the crane trolley divides the functions thereof between the two. The mounting of the lifting frame on the lower end of the revolving pipe creates a stable unit of cables, lifting mechanism, and mast, and forms this unit so that it is inherently pivotable. By this arrangement it is also achieved that a rotation of the mast, together with the load-receiving means relative to the crane trolley, can be carried out.

Because the lifting frame is disposed below the crane carrier, the lifting frame is able to be pivoted through below the crane carrier, and the pivot angle is not hindered by the crane carrier.

Particularly stable support for the mast and the revolving device may be achieved in that the crane carrier includes a first carrier and a second carrier on which trolley rails are disposed, and on which the crane trolley can travel in the trolley travel direction. The first carrier and the second carrier are spaced apart from each other in the crane travel direction, which runs at right angles to the trolley travel direction and the mast extends between the first carrier and the second carrier.

A direct introduction of the lifting forces into the load-receiving means may be achieved in that the cables of the lifting mechanism engage on the load-receiving means, while the mast takes on the guiding functions.

Particularly stable suspension for the load-receiving means may be achieved when at least four cables are provided, the ends of which engage in the region of the corners of an essentially rectangular load-receiving means.

In an advantageous manner, the load-receiving means may include a suspension frame and a spreader frame suspended thereon. The suspension frame is attached in an articulated or rigid manner to the lower end of the mast, and the cables engage on the suspension frame.

These and other objects, advantages and features of this invention will become apparent upon review of the following specification in conjunction with the drawings.

BRIEF DESCRIPTION OF THE DRAWINGS

FIG. 1 shows an overview plan of a handling installation 1 in a port area in which containers 2, in particular ISO containers, are handled. It will be appreciated that the overview plan of FIG. 1 shows only a section of the handling installation 1, but the essential components thereof can be seen. The handling installation 1 includes a land-side handling area 3, a container warehouse 4, and a water-side handling area 5.

Figure 1:
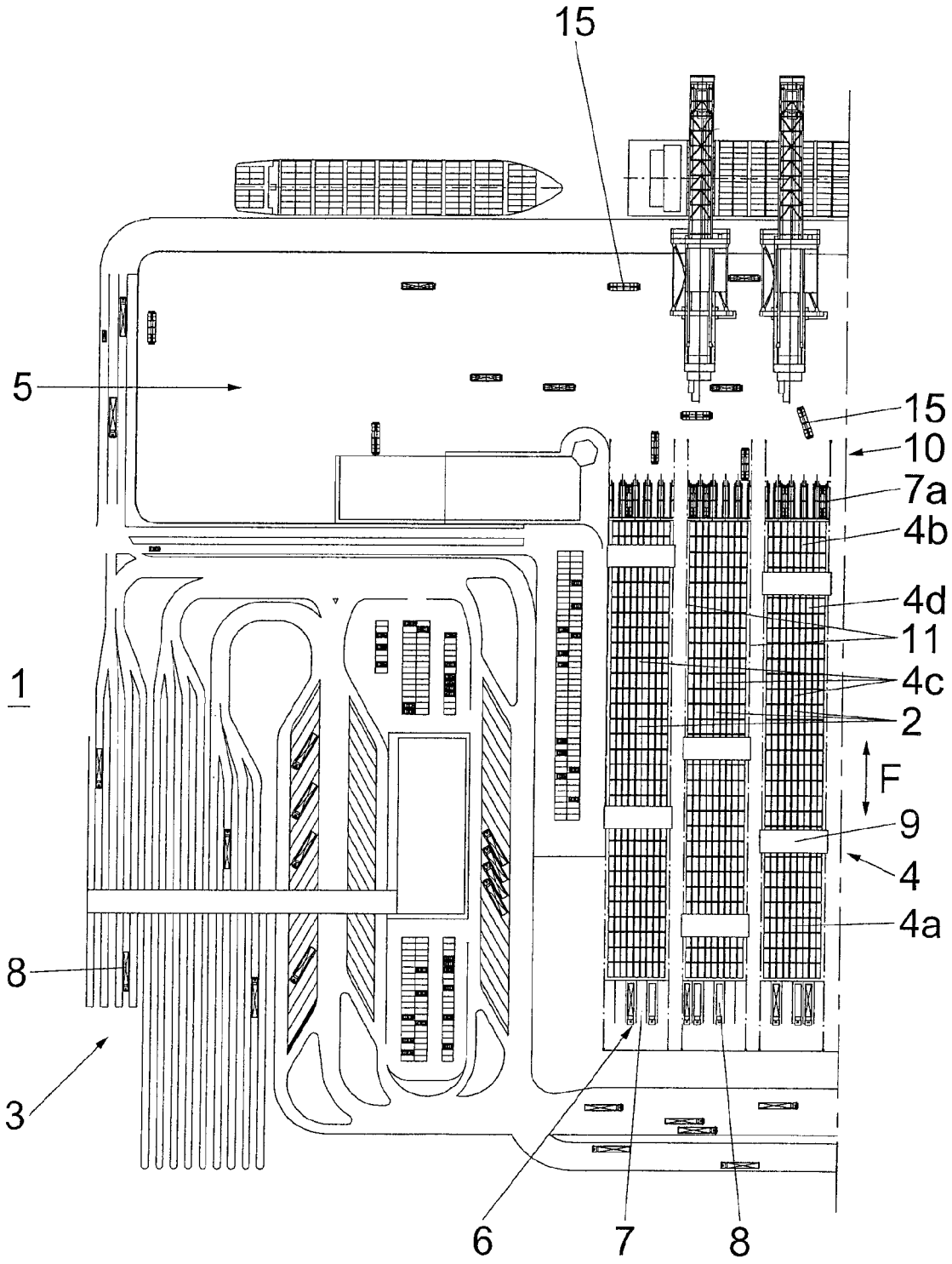
FIG. 1 is a plan view of a handling installation for ISO containers in a port area.

The land-side handling area 3 adjoins a land-side end 4*a* of the container warehouse 4 and has a loading and unloading area 6 which adjoins this and has a plurality of parking spaces 7 disposed next to each other for trucks or lorries 8 to be loaded and unloaded. In the loading and unloading area 6, a lorry 8 parked in one of the parking spaces 7 is loaded and/or unloaded by a bridge crane or gantry crane 9 operating in the container warehouse 4.

The container warehouse 4 includes a plurality of container warehouse areas 4*c*, which are disposed linearly and in parallel next to each other, to which in each case at their respective land-side ends 4*a* a loading and unloading area 6 is allocated, and at their respective water-side ends 4*b* an area 10 is allocated where containers are placed into and removed from storage. Each container warehouse area 4*c* is allocated one or a plurality of bridge cranes or gantry cranes 9, which can travel along the container warehouse areas 4*c* in the crane travel direction F on rails 11. The containers 2 are transported by the bridge crane or gantry crane 9 between the container warehouse area 4*c* and the loading and unloading area 6 or the area 10 where containers are placed into and removed from storage. In addition to the one or a plurality of bridge cranes or gantry cranes 9, each container warehouse area 4*c* also has a set-down area 4*d* for the containers 2. The set-down area 4*d* has a rectangular base surface on which the containers 2 are disposed in rows and columns. In this case up to five containers 2 are stored stacked one on top of the other. The set-down containers 2 are oriented with their longitudinal extensions or axes essentially in parallel with the rails 11, and therefore generally aligned in the crane travel direction F of the bridge cranes or gantry cranes 9. This orientation of the containers 2 is also found in the loading and unloading area 6 with the incoming and outgoing lorries 7, so that the respective bridge cranes or gantry cranes 9 do not have to pivot the containers 2 apart from any necessary alignment corrections during pick-up and put-down. At the water-side end 4*b* of the container warehouse 4, the containers 2 are set down by the bridge crane or gantry crane 9 in the area 10 where containers are placed into and removed from storage, or are picked up therefrom. The area 10 where containers are placed into and removed from storage serves as an interface with respect to the water-side handling area 5, and has a plurality of support frames 7*a* disposed next to each other for containers 2, into which driverless transport vehicles 15 with lifting tables (not shown) can travel in order to pick up the containers 2 intermediately stored therein, or to set them down therein. It is also possible for the containers 2 to be picked up directly by means of the bridge crane or gantry crane 9 from the platform thereof, or to be set down at this location. In that case support frames 7*a* may be provided, and the driverless transport vehicles 15 would typically have no lifting tables.

Figure 2:
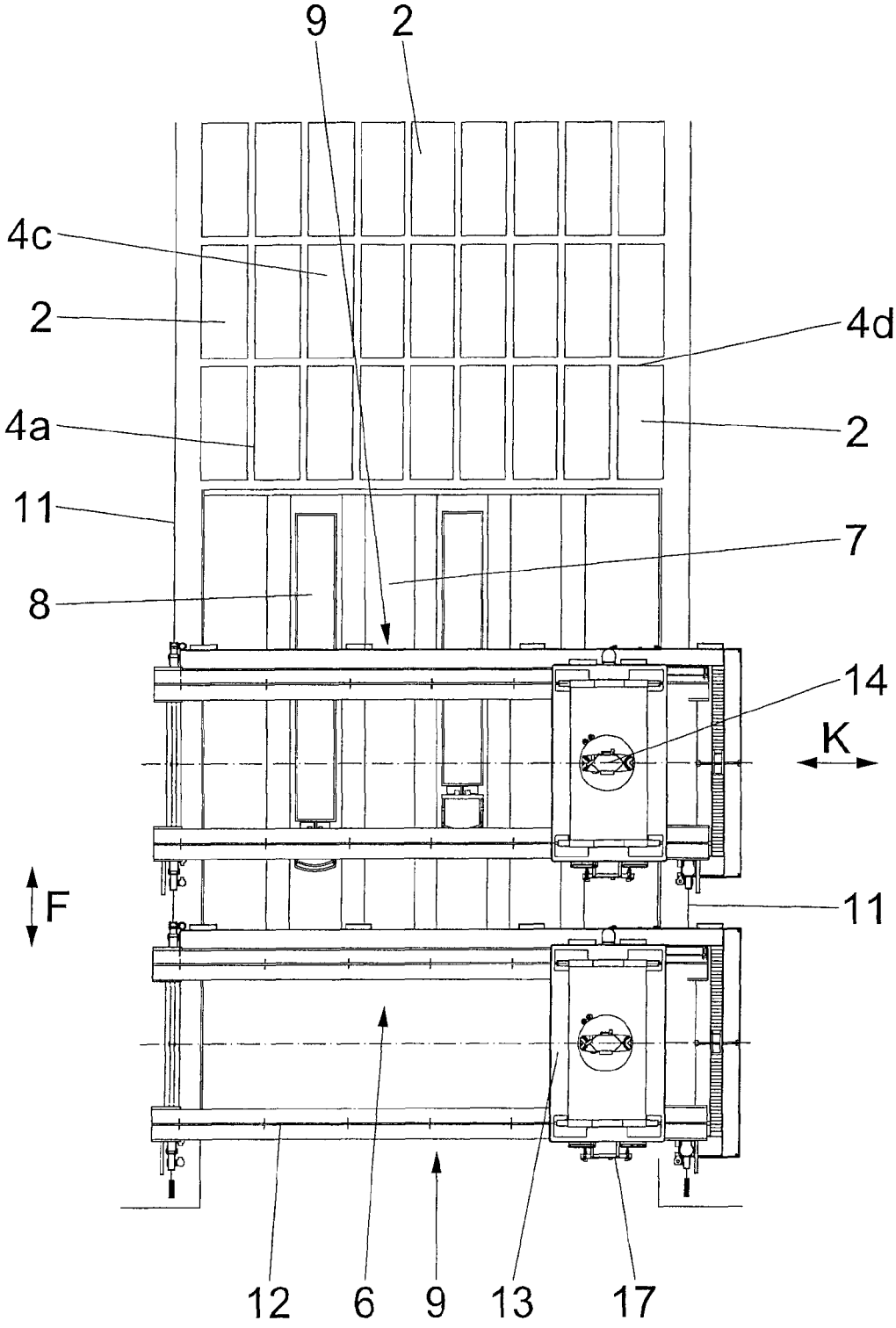
FIG. 2 is an enlarged portion of the plan view of FIG. 1, taken from the region of a loading and unloading area of the container warehouse of the handling installation.

FIG. 2 shows an enlarged section of FIG. 1 from the region of the loading and unloading area 6 and a part of an adjoining container warehouse area 4*c*. It is clear that in each loading and unloading area 6, a plurality of parking spaces 7 for lorries 8 are disposed next to each other and with the smallest possible or practical spacing with respect to each other. Furthermore, FIG. 2 provides detailed structure of the bridge crane or gantry crane 9. Two bridge cranes or gantry cranes 9 are shown on common rails 11. This bridge crane or gantry crane 9 includes a crane carrier 12, which can travel in the crane travel direction F along the rails 11, which in turn are disposed laterally next to the set-down areas 4*d* of the respective container warehouse area 4*c*, on which crane carrier a crane trolley 13 can travel in the trolley travel direction K, which is transverse to the travel direction F of the crane carrier 12. A mast 14 is disposed on the crane trolley 13 and is guided so as to be raised and lowered vertically and relative to the crane trolley 13 in order to pick up and put down containers 2 using a load-receiving means 17, such as a spreader frame, which is mounted on its lower end 14*a* (FIG. 3).

In order to be able to rotate the containers 2 by 180 degrees about a vertical axis, the bridge crane or gantry crane 9 is fitted with a revolving device 16. By means of the revolving device 16, the orientation of the containers 2 can be changed by the bridge crane and gantry crane 9 so that the doors of the container 2, which are disposed on only one side at a longitudinal end of the container 2, face the desired direction. This avoids the situation of the transport vehicles 15 having to carry out the time-consuming rotation of the containers 2. The revolving device 16 can also be used to set down the containers 2 at an angle of, for example, about 30 degrees to the crane travel direction K, onto the lorries 7 and/or the transport vehicles 15, when the parking spaces 7 and/or the support frames 7*a* are disposed at an angle with respect to the crane travel direction K.

Figure 3:
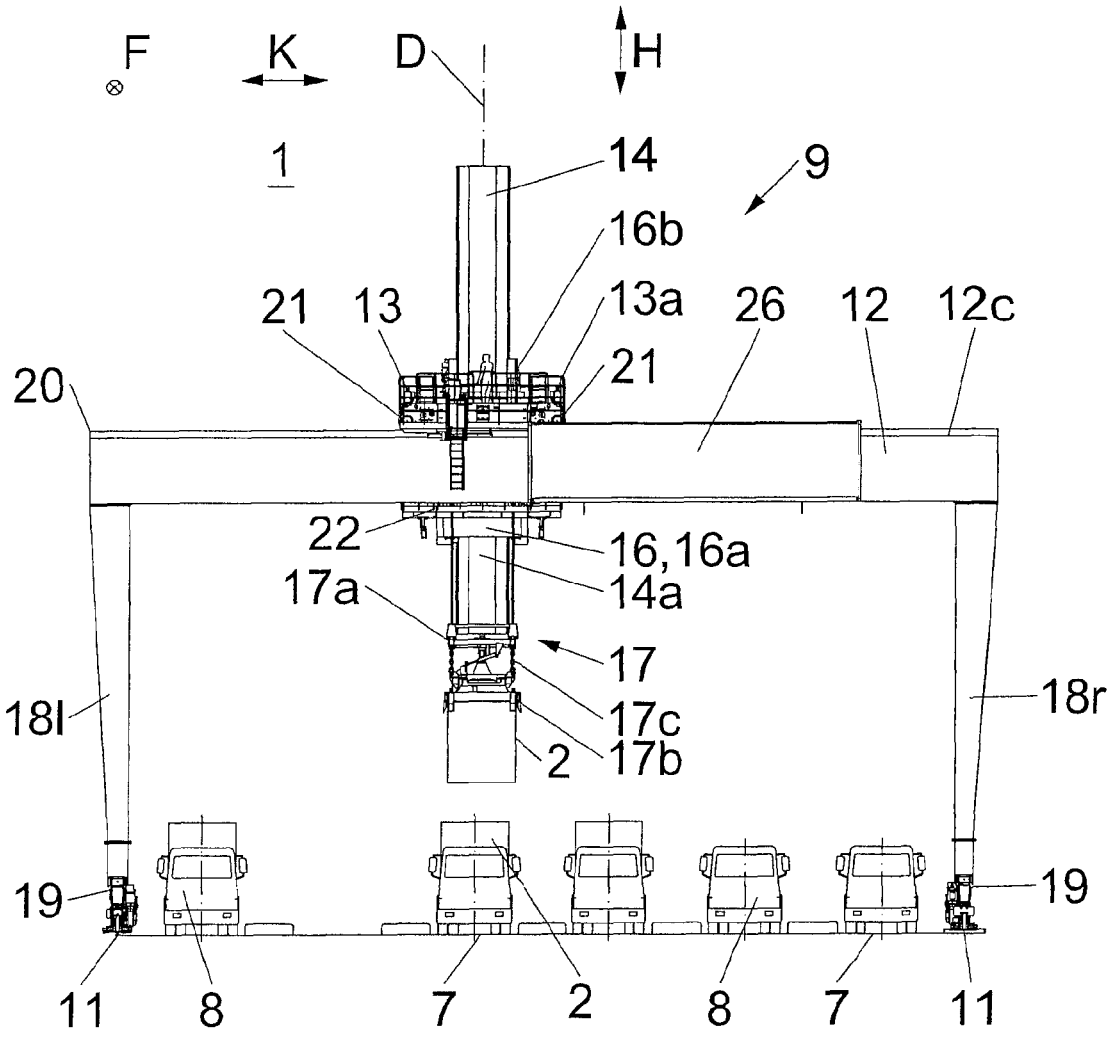
FIG. 3 is a plan view of another handling installation of the invention, with a bridge crane or gantry crane shown in the region of a land-side loading and unloading area.

FIG. 3 shows a view of another handling installation with a bridge crane or gantry crane in accordance with the invention, including a gantry crane. It will be observed that the load-receiving means 17 is divided into a suspension frame 17*a* that is universally or fixedly mounted on a lower end 14*a* of the mast 14, and a spreader frame 17*b* that is suspended via chains 17*c* on the suspension frames 17*a*.

Furthermore, the crane carrier 12 is supported on its opposite ends via vertical supports 18*l* and 18*r*, which are on the right and left when viewed in the crane travel direction F. The bridge crane or gantry crane 9, when viewed in the crane travel direction F, is generally U-shaped and open at the bottom (i.e., as an inverted 'U'). At their upper ends, the vertical supports 18*l* and 18*r* receive the crane carrier 12 at the opposite end regions thereof, and are able to travel in the crane travel direction F on their lower ends via crane running gears 19 on the rails 11.

The crane trolley 13 includes a rectangular base frame 13*a*, in the four corners of which trolley miming gears 21 are disposed, which running gears travel on trolley rails 20 disposed on the crane carrier 12. Located in the middle area of the base frame 13*a* of the crane trolley 13 is an opening for a revolving device 16 for the mast 14. The revolving device 16 includes a revolving pipe 16*a*, which is guided through the opening in the vertical direction. The revolving pipe 16*a* is supported at its upper end 16*b* via a revolving connection 16*c* on the base frame 13*a* of the crane trolley 13, and is able to rotate via the revolving connection 16*c* about a vertical axis of rotation D. The mast 14 extends within the revolving pipe 16*a* and is guided therein.

Figure 4:
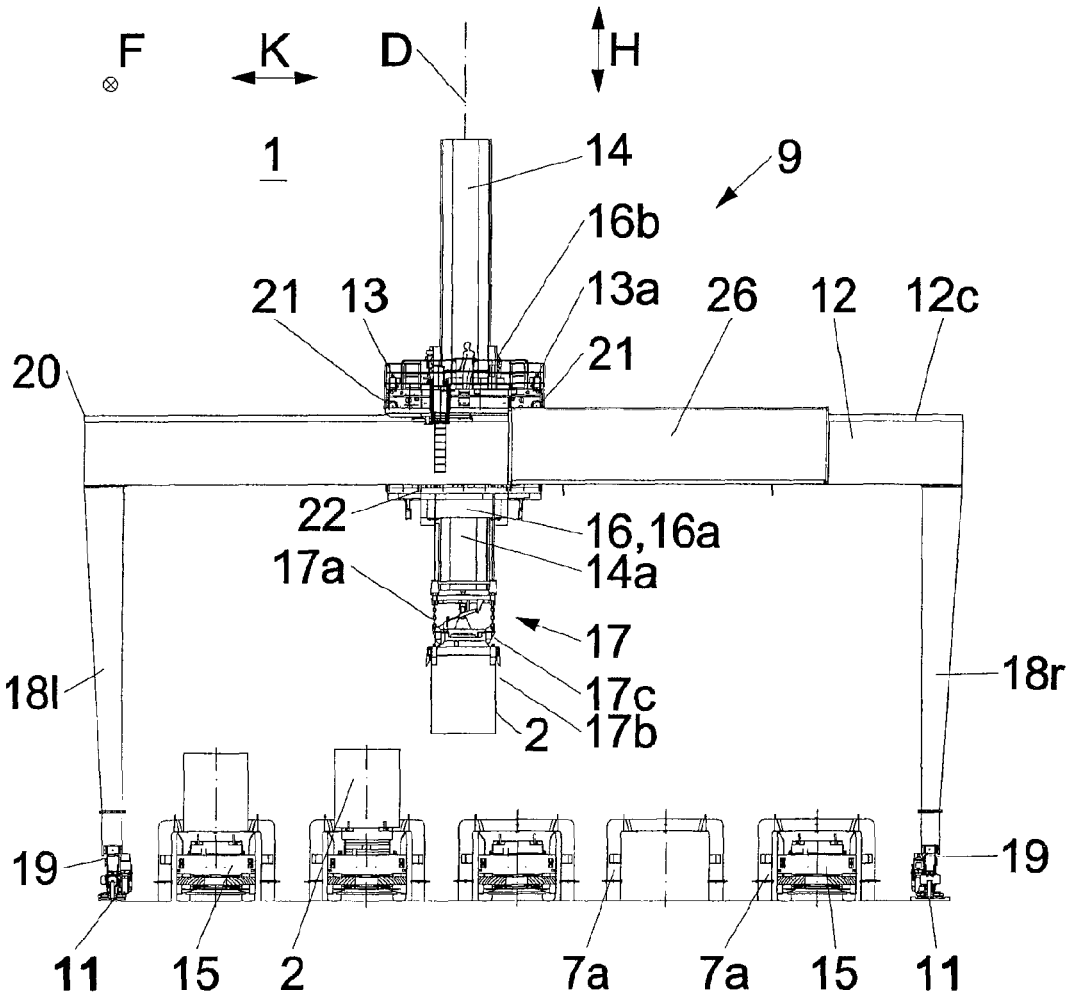
FIG. 4 is a plan view of another handling installation of the invention, with a bridge crane or gantry crane shown in the region of a water-side loading and unloading area.

As best shown in FIG. 4, the crane carrier 12 is formed as a double carrier with a first carrier 12*a* and a second carrier 12*b* which, when viewed in the crane travel direction F, are disposed at the same height and spaced apart one behind the other. In a corresponding manner, the left vertical support 181 and the right vertical support 18*r* are formed as double supports when viewed in the crane travel direction F, which supports are connected to each other via a base beam 18*a* in the region of their lower end to generally form a U-shape.

The first carrier 12*a* and the second carrier 12*b* each have a triangular cross-section (FIG. 4). In the illustrated embodiment, the triangular cross-section is in the form of an isosceles triangle, wherein the angle in the region of the apex 12*c* is about 30 degrees. In the region of the apex 12*c* of the first carrier 12*a* and the second carrier 12*b*, the respective trolley rail 20 is mounted, and on which the crane trolley 13 can travel in the trolley travel direction K.

In order to drive the revolving pipe 16*a*, a toothed ring 16*f* extends around the outer side of the revolving pipe 16*a*, and is engaged with an electromotive revolving drive 16*g*, which is supported on the base frame 13*a* (FIG. 4). In order to move the mast 14 in the lifting and lowering direction H, a rectangular lifting frame 22 is rigidly attached to a lower end 16*d* of the revolving pipe 16*a*. A lifting mechanism 23 for the mast 14 is disposed on the lifting frame 22 of the crane trolley 13. The lifting mechanism 23 has a first cable drum 23*a* and a second cable drum, which are mounted coaxial to each other and on a common drive 23*b*, which is driven by a drive motor 23*e*. A first cable 24*a* and a second cable 24*b* run from the first cable drum 23*a*. A third cable 24*c* and a fourth cable 24*d* run from the second cable drum. Accordingly four cables 24*a*, 24*b*, 24*c* and 24*d* are provided, which either run vertically downwards directly from the first cable drum 23*a* or second cable drum, or are guided horizontally onto the opposite side of the mast 14, and at that location are deflected vertically downwards through 90 degrees via a deflecting roller 25 with a horizontal axis of rotation. The ends of the cables 24*a*, 24*b*, 24*c* and 24*d* are connected to a suspension frame 17*a*.

Control and power electrics or electronics for the bridge crane or gantry crane 9 are disposed in a container-like box 26, which is attached to the outside of the second support 12*b* (FIG. 4).

Figure 5:
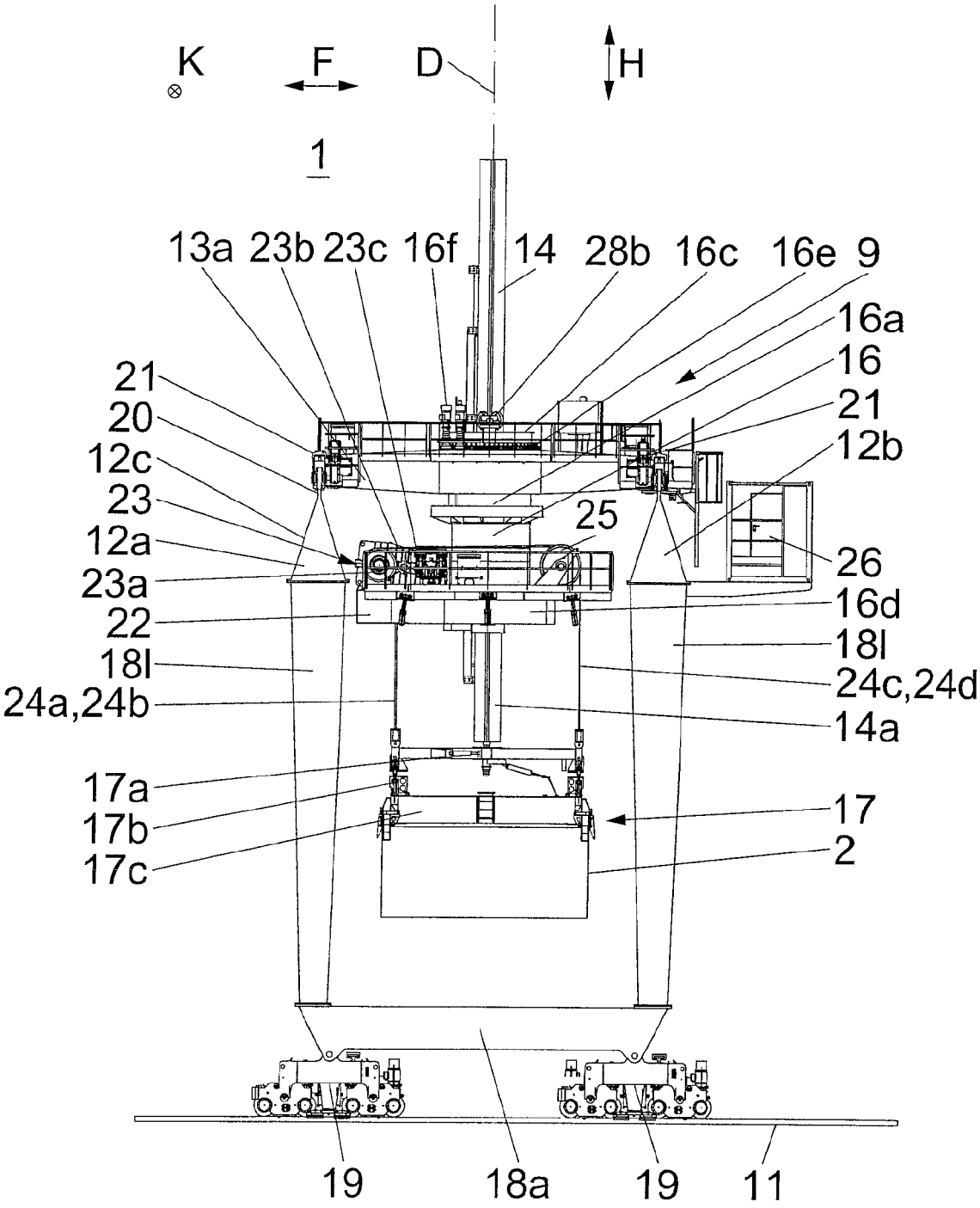
FIG. 5 is a side view of the handling installation of FIG. 3.

From the cross-sectional view of FIG. 5 it is observed that the mast 14 is guided in each case via lower guide elements 28*a* in the region of the lower end 16*d* of the revolving pipe 16*a*, and via upper guide elements 28*b* in the region of the upper end 16*c* of the revolving pipe 16*a*. The lower and upper guide elements 28*a* and 28*b* are formed as guide rollers which guide the mast 14 from four respective sides, and also in an opposing arrangement. For the purposes of stabilisation, the mast 14 has an elongated hexagonal cross-section.

In the illustrated embodiment of FIG. 5, the crane trolley 13 does not support the lifting mechanisms 23 in the usual manner, but for this purpose a separate lifting frame 22 is provided which is rotatably suspended on the crane trolley 13 with the trolley running gears 21 via a revolving device 16. The lifting mechanism 23 and associated deflecting rollers 25 are then disposed on the lifting frame 22 (FIG. 4). This is advantageous in that the lifting frame 22, the lifting mechanism 23 disposed thereon with the deflecting rollers 25, the mast 14, the load-receiving means 17, and the first to fourth cables 24*a* to 24*d* extending between the lifting frame 22 and the load-receiving means 17 are able to pivot jointly about the axis of rotation D. These parts therefore form an inherently stable unit which furthermore guides the load-receiving means 17 to substantially limit or prevent lateral deflections.

Figure 6:
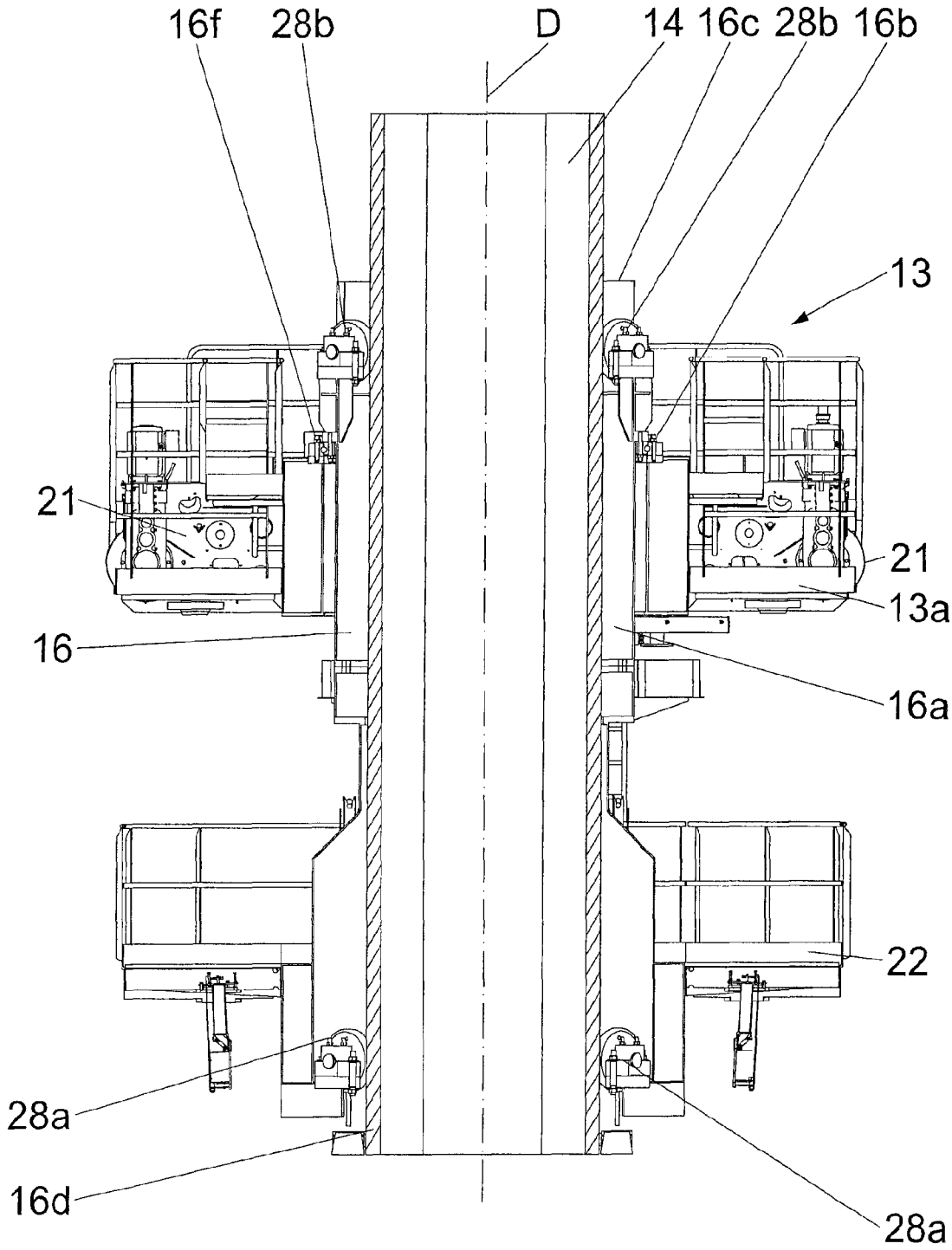
FIG. 6 is an enlarged section and partial cross-section view of a portion of FIG. 3, taken from the region where a mast is guided.
Figure 7:
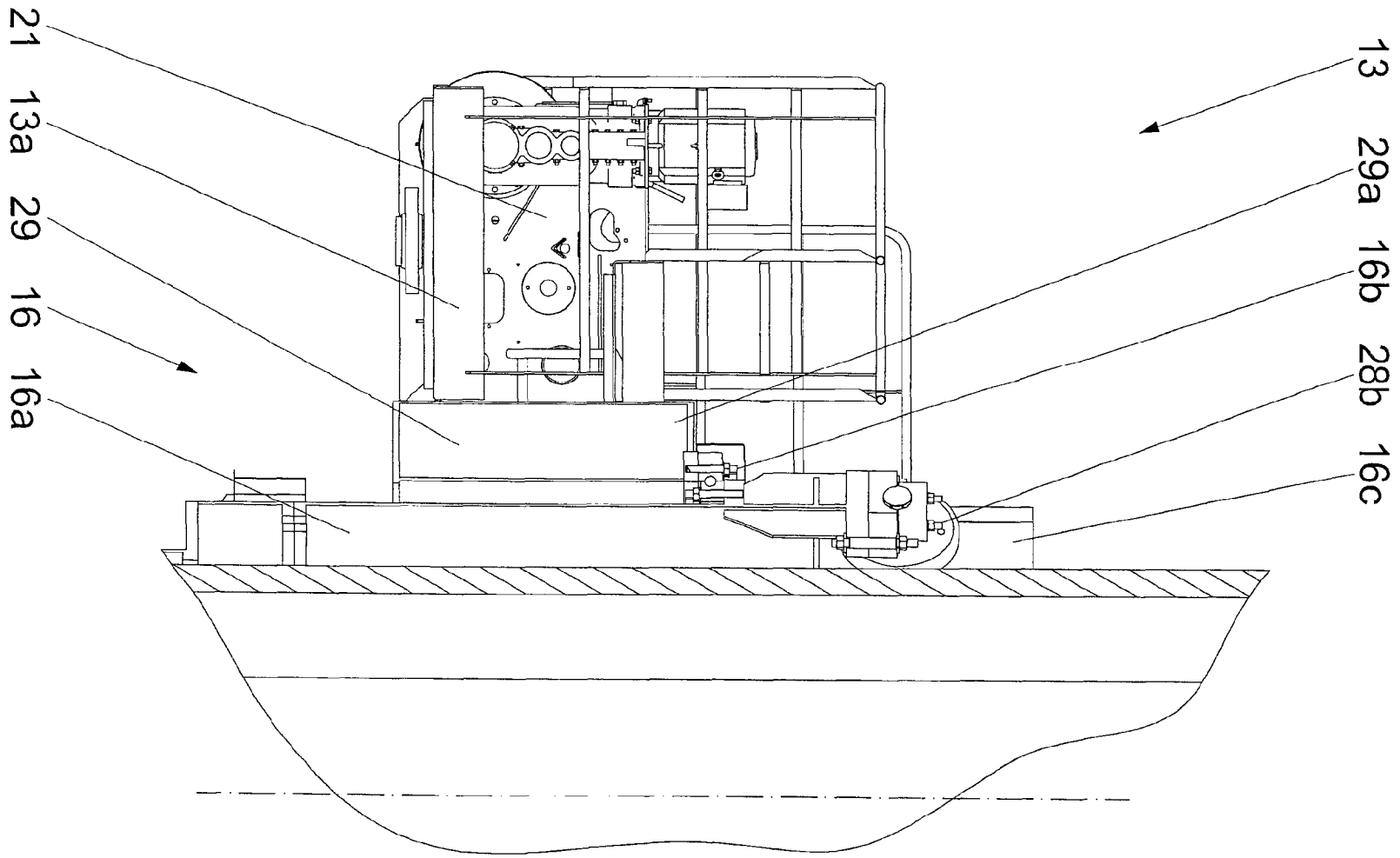
FIG. 7 is an enlarged section view of another portion of FIG. 3, taken from the region of a revolving connection.

Referring to FIG. 6, it can be seen that, in addition to the revolving pipe 16*a*, the revolving device 16 additionally has a circular pipe-shaped support pipe 29 that surrounds the revolving pipe 16*a* coaxially and is spaced apart therefrom.

This support pipe 29 is supported on the base frame 13*a* of the crane trolley 13. The support pipe 29 serves, with its upper end 29*a*, as a support for a revolving connection 16*b* in the form of a roller bearing. The revolving pipe 16*a* is then supported in the region of its upper end 16*c* on this revolving connection 16. In this way, a stable connection of the crane trolley 13 with the lifting frame 22 is achieved as a whole, with which the lateral guide forces of the mast 14 can be absorbed.

Although the above description relates to a bridge crane or gantry crane 9 which is formed as a gantry crane, it will be appreciated that it is fundamentally also possible to form the bridge crane or gantry crane as a bridge crane with raised or elevated rails, or as a semi-gantry crane. Furthermore, while the exemplified embodiments relate to ISO container handling in a port area, the bridge cranes or gantry cranes of the present invention may also be suitable for handling standard load carriers such as for example, ISO containers or swap bodies between road and rail.

Changes and modifications to the specifically described embodiments may be carried out without departing from the principles of the present invention, which is intended to be limited only by the scope of the appended claims, as interpreted by the principles of patent law including the doctrine of equivalents.

The invention claimed is:

1. A bridge crane or gantry crane for handling standard load carriers, said crane comprising:

a crane carrier;

a crane trolley that is movable along the crane carrier in a trolley travel direction;

a rigid, single-pieced and non-telescopic mast guided on the crane trolley, wherein the mast extends in a lifting and lowering direction;

at least one lifting mechanism comprising a cable drum, a common drive and a drive motor disposed at the crane trolley for moving the mast in the lifting and lowering direction via cables;

a load-receiving device for standard load carriers attached at a lower end of the mast, wherein the mast is suspended on the crane trolley so as to be rotatable about an axis of rotation extending in the mast's longitudinal direction;

a revolving arrangement on the crane trolley, the revolving arrangement including a revolving pipe with an upper end and a lower end, the upper end of the revolving pipe supported on the crane trolley via a revolving connection;

a lifting frame suspended by the revolving arrangement via attachment of the lifting frame to the lower end of the revolving pipe, the lifting frame supporting the lifting mechanism for moving the mast in the lifting and lowering direction via cables running between the lifting frame and the load-receiving device; and wherein the mast is arranged coaxially to the revolving pipe and is guided in such a way that the mast can be raised and lowered in the revolving pipe, and wherein the lifting frame is disposed below the crane carrier.

2. The crane as claimed in claim 1, wherein the cables of the lifting mechanism engage the load-receiving device.

3. The crane as claimed in claim 2, wherein the load-receiving device is substantially rectangular, and wherein the cables comprise at least four cables having respective ends that engage respective corners of the substantially rectangular load-receiving device.

4. The crane as claimed in claim 2, wherein the load-receiving device comprises a suspension frame and a spreader frame suspended thereon, wherein the suspension frame is attached to the lower end of the mast in an articulated or rigid manner and the cables engage the suspension frame.

5. The crane as claimed in claim 1, wherein the load-receiving device is substantially rectangular, and wherein the cables comprise at least four cables having respective ends that engage respective corners of the substantially rectangular load-receiving device.

6. The crane as claimed in claim 5, wherein the load-receiving device comprises a suspension frame and a spreader frame suspended thereon, wherein the suspension frame is attached to the lower end of the mast in an articulated or rigid manner and the cables engage the suspension frame.

7. The crane as claimed in claim 1, wherein the load-receiving device comprises a suspension frame and a spreader frame suspended thereon, wherein the suspension frame is attached to the lower end of the mast in an articulated or rigid manner and the cables engage the suspension frame.

8. The crane as claimed in claim 1, wherein:

the crane carrier comprises a first carrier and a second carrier of the crane carrier, and respective trolley rails disposed on the first and second carriers;

the crane trolley can travel in the trolley travel direction;

the first carrier and the second carrier are spaced apart from each other in a crane travel direction;

the crane travel direction is oriented at right angles to the trolley travel direction; and the mast extends between the first carrier and the second carrier.

9. The crane as claimed in claim 8, wherein the load-receiving device is substantially rectangular, and wherein the cables comprise at least four cables having respective ends that engage respective corners of the substantially rectangular load-receiving device.

10. The crane as claimed in claim 8, wherein the load-receiving device comprises a suspension frame and a spreader frame suspended thereon, wherein the suspension frame is attached to the lower end of the mast in an articulated or rigid manner and the cables engage the suspension frame.

11. The crane as claimed in claim 8, wherein the cables of the lifting mechanism engage the load-receiving device.

12. The crane as claimed in claim 11, wherein the load-receiving device is substantially rectangular, and wherein the cables comprise at least four cables having respective ends that engage respective corners of the substantially rectangular load-receiving device.

13. The crane as claimed in claim 12, wherein the load-receiving device comprises a suspension frame and a spreader frame suspended thereon, wherein the suspension frame is attached to the lower end of the mast in an articulated or rigid manner and the cables engage the suspension frame.

14. The crane as claimed in claim 11, wherein the load-receiving device comprises a suspension frame and a spreader frame suspended thereon, wherein the suspension frame is attached to the lower end of the mast in an articulated or rigid manner and the cables engage the suspension frame.

* * * * *

UNITED STATES PATENT AND TRADEMARK OFFICE

CERTIFICATE OF CORRECTION

PATENT NO. : 8,800,791 B2
APPLICATION NO. : 13/133532
DATED : August 12, 2014
INVENTOR(S) : Hermann Franzen et al.

It is certified that error appears in the above-identified patent and that said Letters Patent is hereby corrected as shown below:

In the Specification

Column 5
Line 18, “miming” should be --running--;
Line 34, “181” should be --18I--;
Line 57, “23e” should be --23c--.

Signed and Sealed this
Twenty-second Day of September, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,800,791 B2
APPLICATION NO. : 13/133532
DATED : August 12, 2014
INVENTOR(S) : Hermann Franzen et al.

It is certified that error appears in the above-identified patent and that said Letters Patent is hereby corrected as shown below:

IN THE SPECIFICATION

Column 5

Line 34, "18I" should be --18*l*--.

Signed and Sealed this
Twenty-third Day of February, 2016

Michelle K. Lee

Michelle K. Lee
*Director of the United States Patent and Trademark Office*